US012022969B1

(12) United States Patent
Waltereze

(10) Patent No.: US 12,022,969 B1
(45) Date of Patent: Jul. 2, 2024

(54) PARCEL DELIVERY LOCKER CONFIGURED FOR ASSEMBLY AFTER SHIPMENT

(71) Applicant: JUGGERNAUT SPARK DEVELOPMENT LLC, Stevenson Ranch, CA (US)

(72) Inventor: Walter C. Waltereze, Stevenson Ranch, CA (US)

(73) Assignee: JUGGERNAUT SPARK DEVELOPMENT LLC, Stevenson Ranch, CA (US)

( * ) Notice: Subject to any disclaimer, the term of this patent is extended or adjusted under 35 U.S.C. 154(b) by 0 days.

(21) Appl. No.: 18/239,465

(22) Filed: Aug. 29, 2023

Related U.S. Application Data

(63) Continuation of application No. 18/095,841, filed on Jan. 11, 2023, now abandoned.

(51) Int. Cl.
*A47G 29/14* (2006.01)

(52) U.S. Cl.
CPC ..... *A47G 29/141* (2013.01); *A47G 2029/144* (2013.01); *A47G 2029/149* (2013.01)

(58) Field of Classification Search
CPC ..... A47G 29/141; A47G 29/20; A47G 29/22; A47G 2029/144; A47G 2029/149; B65D 7/28; B65D 7/30; B65D 7/32; B65D 9/18; B65D 9/22; B65D 9/24; B65D 11/18; B65D 11/1846; B65D 21/086
See application file for complete search history.

(56) References Cited

U.S. PATENT DOCUMENTS 1,198,524 A * 9/1916 Cunliffe ..... B65D 7/26 220/6
1,673,769 A * 6/1928 Graham ..... G07C 13/02 220/6
1,915,980 A * 6/1933 Craft ..... A47G 29/12 232/19
2,098,469 A 11/1937 Smith
2,379,202 A 6/1945 Van Wagner et al.
3,246,828 A * 4/1966 Branscum ..... B65D 1/225 220/6
3,865,269 A 2/1975 Coleman
3,966,285 A * 6/1976 Porch ..... B65D 7/24 312/263
4,589,588 A 5/1986 Swanhart
4,789,075 A * 12/1988 Sun ..... B65D 11/1846 206/508
4,944,422 A 7/1990 Aurness et al.
5,161,709 A * 11/1992 Oestreich, Jr. ..... B65D 25/005 220/4.28
5,253,763 A 10/1993 Kirkley et al.
(Continued)

*Primary Examiner* — William L Miller
(74) *Attorney, Agent, or Firm* — The Concept Law Group, PA; Scott D. Smiley; Scott M. Garrett

(57) ABSTRACT

A parcel delivery locker has a body portion formed by four panels that are joined to each other along hinge joints at their vertical edges. The hinges joints allow the body portion to be alternatively configured into a stack for shipping, or as a box for use in receiving and containing parcels. A lid is joined to the body portion during assembly and has an electronically controlled locking mechanism that can be wirelessly controlled to lock or unlock. A floor portion is coupled to the four panels as well.

20 Claims, 25 Drawing Sheets

(56) References Cited

U.S. PATENT DOCUMENTS 5,323,921 A * 6/1994 Olsson ..... B65D 45/24 220/6
D396,005 S * 7/1998 Teags ..... D9/434
5,941,405 A 8/1999 Scales et al.
6,032,815 A * 3/2000 Elstone ..... B65D 77/061 220/666
6,182,849 B1 * 2/2001 Elstone, Sr. ..... B65D 19/12 220/4.28
6,216,899 B1 * 4/2001 Vicari ..... B65D 19/16 206/600
6,426,699 B1 7/2002 Porter
6,612,489 B2 9/2003 McCormick et al.
7,243,674 B2 7/2007 Devine
9,714,113 B2 * 7/2017 Jung ..... B65D 71/04
10,143,321 B2 12/2018 Hippert
10,321,780 B1 6/2019 James
10,537,196 B1 1/2020 MacPherson
10,696,453 B2 * 6/2020 Sena ..... A47G 29/141
10,743,694 B2 8/2020 Raphael et al.
10,743,695 B1 8/2020 Altmaier
10,758,071 B1 9/2020 Lin et al.
11,116,345 B2 9/2021 Sankaran
11,206,939 B2 12/2021 Sundaresan
11,278,144 B2 2/2022 Vernal Silva et al.
11,311,132 B2 4/2022 Elvaz
11,492,172 B1 * 11/2022 Izquierdo ..... A47G 29/141
11,510,517 B2 * 11/2022 McLean ..... B65D 11/1853
11,825,972 B2 * 11/2023 Grijalva ..... A47G 29/141
11,873,595 B2 * 1/2024 Cohen ..... D06F 95/002
11,896,150 B2 * 2/2024 Chiappetta ..... E05G 1/005
2001/0040422 A1 * 11/2001 Gramlich ..... G07F 17/13 340/532
2005/0150812 A1 * 7/2005 Carter ..... B65D 11/1846 206/600
2006/0237455 A1 * 10/2006 Vargas ..... B65D 11/1873 220/4.34
2008/0302789 A1 * 12/2008 Stevenson ..... B65D 11/28 220/666
2009/0020527 A1 * 1/2009 Chen ..... B65D 7/32 220/4.04
2016/0066733 A1 3/2016 Gozar
2017/0127868 A1 5/2017 Adewuyi
2017/0174390 A1 * 6/2017 Clark ..... E05G 1/005
2017/0188737 A1 * 7/2017 Hippert ..... A47G 29/20
2017/0286905 A1 * 10/2017 Richardson ..... G06Q 10/0836
2018/0070753 A1 * 3/2018 Eveloff ..... H04W 4/025
2018/0339837 A1 * 11/2018 Fitt ..... B65D 11/1866
2019/0225375 A1 * 7/2019 Sena ..... A47G 29/20
2019/0320836 A1 10/2019 Guanch et al.
2020/0015616 A1 * 1/2020 Sankaran ..... A47G 29/124
2022/0097910 A1 * 3/2022 Eldib ..... B65D 21/086
2022/0185535 A1 * 6/2022 Carter ..... B65D 11/1893
2022/0338659 A1 * 10/2022 Abderrazak ..... A47G 29/20
2023/0081315 A1 * 3/2023 Sebro ..... A47G 29/141 232/38

* cited by examiner

PARCEL DELIVERY LOCKER CONFIGURED FOR ASSEMBLY AFTER SHIPMENT

CROSS-REFERENCE

This application is a continuation of U.S. patent application Ser. No. 18/095,841, filed Jan. 11, 2023, the entirety of which is hereby incorporated by reference.

FIELD OF THE INVENTION

The present invention relates generally to a parcel delivery box or locker, and, more particularly, relates to a parcel delivery locker for securely receiving and holding delivered parcels at a delivery address, wherein the parcel deliver locker is provided to the user in a folded, flat configuration that minimizes shipping volume of the parcel delivery locker.

BACKGROUND OF THE INVENTION

Parcel delivery has long been a routine aspect of commerce. Before the Internet it was common for people to order from catalogs, either over the phone, or by mail, and then, often weeks later, a delivery service would deliver a parcel containing the ordered goods at the delivery address. In those times, however, parcel delivery was mostly used for goods that could not be obtained from nearby "brick and mortar" merchants, which of course varied depending on where one lived. The Internet has considerably shifted that paradigm, and now many people routinely order goods online as a convenience rather than taking time to travel to a store and shop for goods. In fact the popularity of online shopping has inhibited the growth of in-person shopping in many retail sectors.

The popularity of online shopping, however, has given rise to certain problems, most notably the theft of parcels. Parcels are typically delivered to the front door of a residence, where they can often be viewed from the street or otherwise by people passing the residence. A parcel sitting in front of a front door implies no one is home to bring the parcel inside, and thus the parcel is an easy target for theft. In 2020, in at least one survey, parcel theft was experienced by over 40% of households, corresponding to billions of dollars of losses.

The people who steal these parcels, sometimes referred to as "porch pirates," depend on two things; being able to see a parcel at a residence, and being able to quickly walk up to the residence and walk away with the parcel. To combat this, delivery drivers who drop off the parcels often try to place the parcel(s) out of direct sight from the street. However this is not always possible. Another way in which people have addressed the problem with by using delivery boxes in which the delivery driver can place parcels to keep them out of sight. Although a person can see the delivery box, the box could be empty, and the would-be thief would have to walk up to the delivery box and look in it, and other such boxes, to find parcels to steal. This requires more effort, and is more likely to draw attention, than most thieves want.

While delivery boxes are known, they are not without their own issues. For one, they are bulky to ship, despite the fact they their shipped volume is mostly air. Second, they lack features that allow a resident to control the delivery box, receive information from the delivery box, and so on.

Therefore, a need exists to overcome the problems with the prior art as discussed above.

SUMMARY OF THE INVENTION

In accordance with some embodiments of the inventive disclosure, there is provides a parcel delivery locker that includes a body portion having four side panels. The four side panels include a left side panel, a front side panel, a right side panel, and a rear side panel. The front panel is hingeably joined to the right side panel and the left side panel, and one of the left side panel or the right side panel is hingeably joined to the rear panel such that the four side panels can be arranged alternatively in a stack or in a box configuration where the rear panel is joined to the other of the left or right panel that is not hingeably joined to the rear panel. The locker further includes a lid that is configured to join to the body portion when the four panels are arranged in the box configuration. The lid includes a joining portion that is configured to fasten to the rear panel and is hingeably joined to a main top portion of the lid. The lid includes an electronically controlled locking mechanism that is operable to lock the top portion of the lid to the body portion. The locker further includes a floor portion that is configured to be fastened to the four side panels at a bottom of each of the four side panels when the four side panels are arranged in the box configuration.

In accordance with a further feature, the lid further comprises a wireless networking transceiver that is configured to receive wireless commands to lock and unlock the lid from the body portion.

In accordance with a further feature, the one of the left side panel or the right side panel that is hingeably joined to the rear panel comprises a joining section that is hingeably joined to one of the left side panel or the right side panel, and wherein the joining section overlaps with a portion of the rear panel to receive fasteners that pass through both the joining section and the rear panel.

In accordance with a further feature, the floor portion comprises at least two joining portions that are hingeably joined to a main floor panel portion wherein the at least two joining portions are on opposite ends of the main floor panel portion and overlap with opposing ones of the four side panels, and wherein fasteners pass through the at least two joining portions and the side panels.

In accordance with a further feature, the fasteners are fastening pegs having a shaft and head, the shaft having a notch at a right angle to an axis of the shaft, and the parcel delivery locker further includes a retaining member having a portion that fits into the notch on each one of the fastening pegs at an inside of the parcel delivery locker.

In accordance with a further feature, the four panels are hingeably joined to each by a plurality of interleaving hinge knuckles along their respective vertical edges, and a hinge pin that passes through each of the plurality of interleaving hinge knuckles, wherein the vertical edges adjacent the interleaving hinge knuckles are chamfered at a forty five degree angle relative to a major surface of the panels.

In accordance with a further feature, the hinge knuckles are disposed on an inside surface of the panels.

In accordance with a further feature, the hinge knuckles have a square cross section.

In accordance with a further feature, the hinge knuckles have a triangular cross section.

In accordance with a further feature, the hinge knuckles fit into corresponding recesses on an adjoining panel.

In accordance with some embodiments of the inventive disclosure, there is provides a parcel delivery locker that includes a body portion. The body portion has a front panel, rear panel opposite the front panel, a left side panel, and a right side panel. The left side panel and the right side panel are both positioned between the front and read panels on opposite sides of the body portion. The right side panel is joined to the rear panel along a first hinge joint along adjacent vertical edges of the rear panel and the right side panel. The right side panel is joined to the front panel along a second hinge joint along adjacent vertical edges of the front panel and the right side panel. The left side panel is joined to the front panel along a third hinge joint along adjacent vertical edges of the front panel and the left side panel. The left side panel is joined to the rear panel along a fourth hinge joint. At least one of the first, second, third, or fourth hinge joints allow at least a 270 degree range of motion so that the body portion can be arranged in a stack. The locker further includes a lid that is configured to join to the body portion when the four panels are arranged in a box configuration. The lid includes a joining portion that is configured to fasten to the rear panel and is hingeably joined to a main top portion of the lid. The lid includes an electronically controlled locking mechanism that is operable to lock the top portion of the lid to the body portion. The locker further includes a floor portion that is configured to be fastened to the rear, front, right side, and left side panels at a bottom of each of the rear, front, right side, and left side panels when the rear, front, right side, and left side panels are arranged in the box configuration.

Although the invention is illustrated and described herein as embodied in a parcel delivery locker, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the article being referenced. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
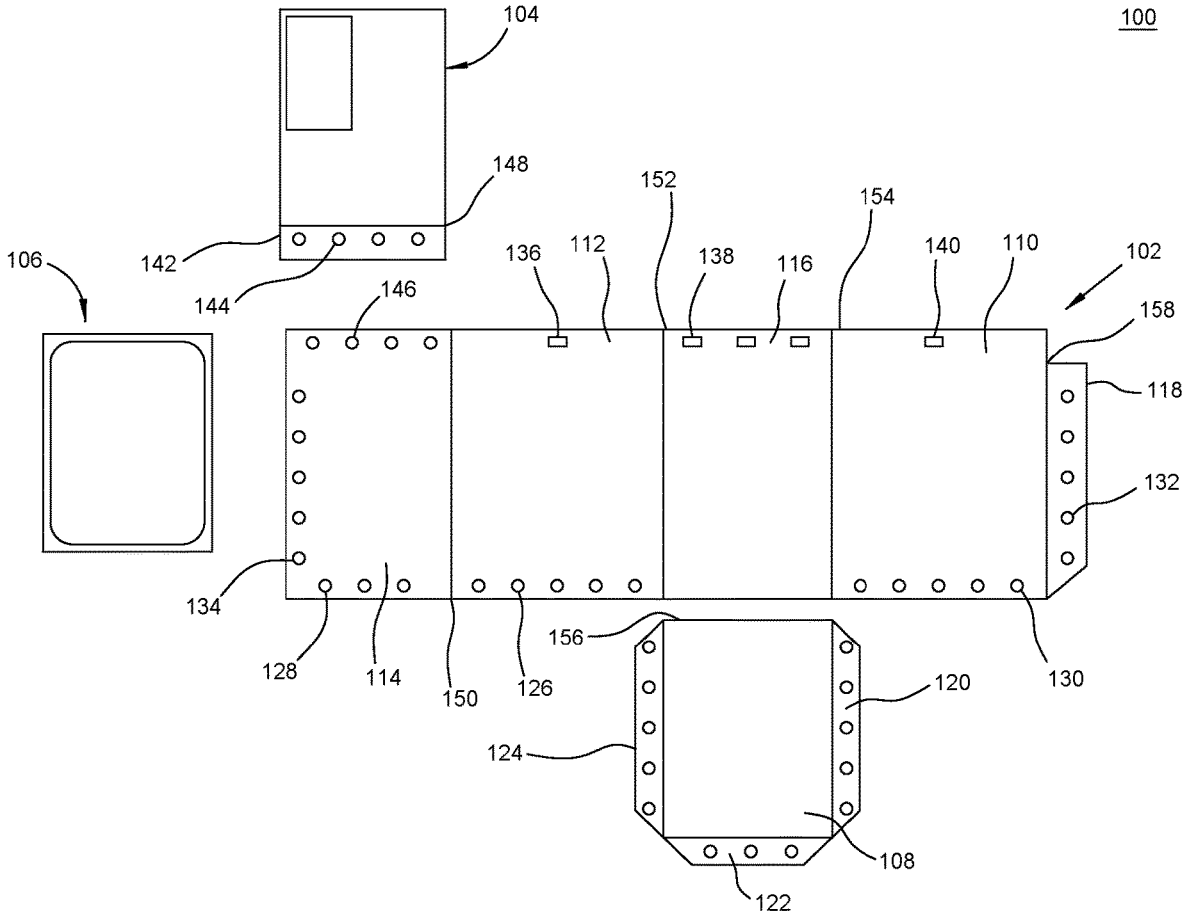
FIG. 1 is a plan view of a parcel delivery locker in an unfolded configuration, prior to assembly, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is a plan view of a parcel delivery locker 100 in an unfolded, flat configuration, prior to assembly, in accordance with some embodiments. The parcel delivery locker 100 includes a body portion 102, a lid or access door 104, a seal 106, and a floor 108. The body portion 102 includes several panels that, upon being assembled, form the vertical walls of the parcel delivery locker 100. In the present embodiment the body portion 102 includes four panels that form the major walls of the parcel delivery locker 100, including a left side panel 110, a front panel 116, and right side panel 112, and a rear panel 114, in addition to a joining section 118 that extends from left side panel 110 and is configured to mate or otherwise couple with rear panel 114. These five sections (four panels and the joining section 118) can be joined to each other so as to be foldable relative to each other, meaning they can be connected along their edges in a generally hinged manner which allows the panels to move relative to each other about their connected edges. The relative term "vertical" used here with regard to the panel/section edges refers to the orientation of the edges upon the parcel delivery locker 100 being assembled and placed in its intended orientation for use. So even though the body portion 102 may be lying flat on a horizontal surface, the edges that join the panels/sections together will be vertical when the parcel delivery locker is in use to receive and hold parcels. In particular, the edges meet along hinge sections 150, 152, 154, 158. The hinge sections 150, 152, 154, 158 are located at vertical edges of the panels, which will be the corners of the parcel delivery locker 100 upon assembly of the parcel delivery locker 100. The panels can be permanently attached to each other using, for example, a flexible outer material along the edges.

FIGS. 3-15I show various examples of hinge structures that can be used to hold panels together and allow them to move into various positions relative to each other about their vertical edges. For these figures, panels 112 and 116 are used as an example. It will be understood that in FIGS. 3-15I the various structures are alternatives, and simply because panels 112, 116 are shown with various alternative hinge structures is not meant to indicate that all of these hinge structures are simultaneously used; they are used alternatively to each other, as may be preferred by a particular application or preference.

Figure 15A:
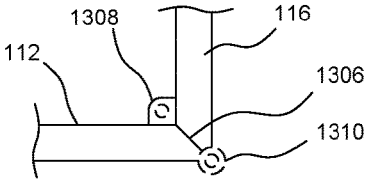
FIG. 15A shows a partial end of connected panels in an assembled configuration in which adhesive is used to join the panels, in accordance with some embodiments.
Figure 15B:
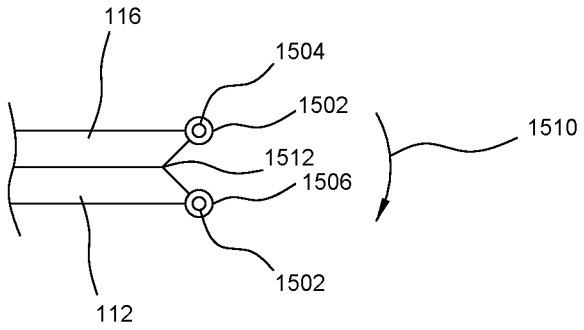
FIG. 15B shows a partial end view of connected panels in a folded configuration with hinge at the internal side of the joint, and the joining structures on the outside, in accordance with some embodiments.
Figure 15C:
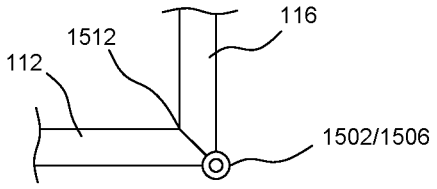
FIG. 15C shows a partial end view of connected panels in an assembled configuration with hinge at the internal side of the joint, and the joining structures on the outside, in accordance with some embodiments.
Figure 15D:
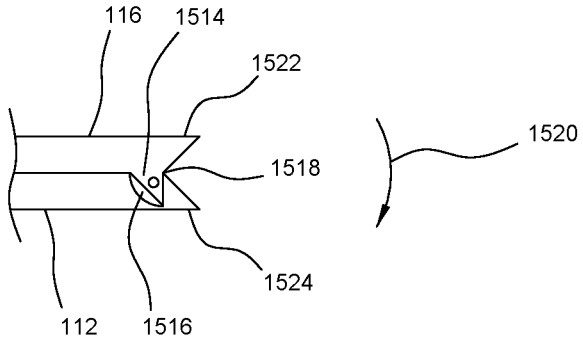
FIG. 15D shows a partial end view of connected panels for a parcel delivery locker in a folded configuration in which the joining structures of each panel alternate and fit into corresponding recesses in the adjacent panel, in accordance with some embodiments.
Figure 15E:
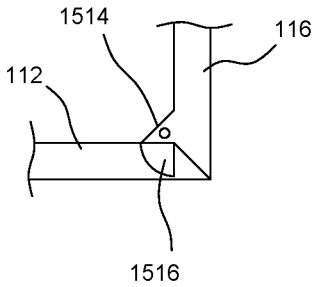
FIG. 15E shows a partial end view of connected panels for a parcel delivery locker in an assembled configuration in which the joining structures of each panel alternate and are aligned to receive a hinge pin through them, in accordance with some embodiments.
Figure 15F:
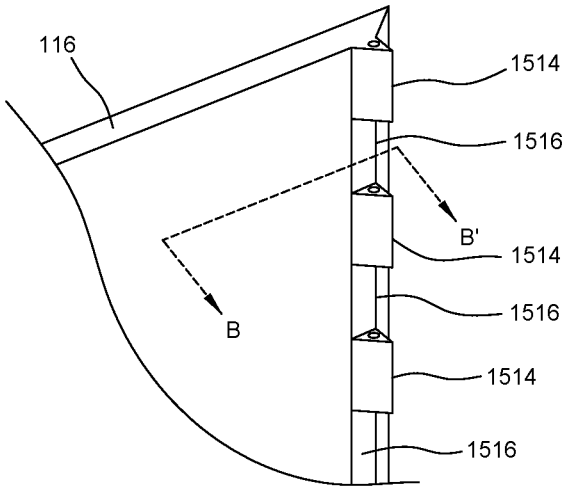
FIG. 15F shows a partial perspective view of a panel that is unconnected from an adjacent panel with alternating joining structures and recesses, in accordance with some embodiments.
Figure 15G:
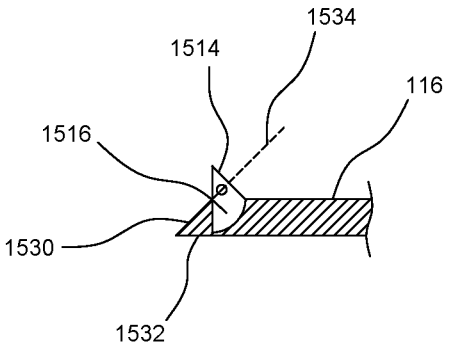
FIG. 15G shows a cross section view of a panel taken along line B-B' showing a joining structure and recess, in accordance with some embodiments.
Figure 15H:
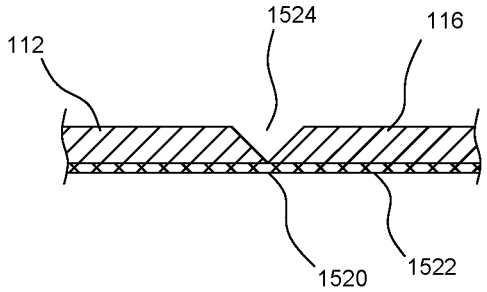
FIG. 15H shows a cross section view of two panels forming a hinge section in a flat position, in accordance with some embodiments.
Figure 15I:
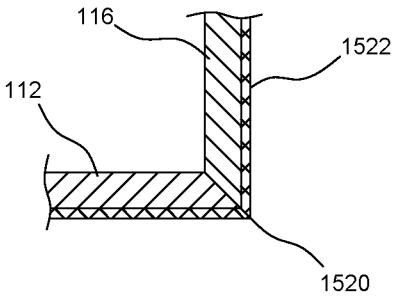
FIG. 15I shows a cross section view of two panels forming a hinge section in a folded position, in accordance with some embodiments.

For example, FIG. 15H shows a cross sectional view of side panel 112 and front panel 116. These panels 112, 116 can be made of a plastic material in some embodiments. The hinge section between the panels 112, 116 is formed by a "V" shaped groove 1524 that forms opposing flat surfaces at a right angle to each other when the panels 112, 116 are coplanar, and at a forty five degree angle to the major surfaces of the panels 112, 116. On the side of the panels 112, 116 opposite the groove 1524 is a tape 1522 that covers the outside surface over the corner location 1520. The panels 112, 116 can be completely separate, or they can be joined by a thin amount of material between the vertex of the groove 1524 and the outside surface where the tape 1524 is placed. In either case, the two panels 112, 116 can be moved from their coplanar position shown here to being at right angles to each other as in FIG. 15I. The tape 1522, can be limited to less than the entirety of the outside surfaces of the panels 112, 116.

Other configurations for joining the panels will be illustrated in subsequently described drawings. As with hinge sections 150, 152, 154, 158, similar joints can be formed between the floor panel 108 and the front panel 116 along edge 156. And the lid 104 includes a joining portion 142 that joins to the back panel 114 and has a hinge section 148 between the joining portion 142 and the main portion of the lid 104. However the floor panel 108 and lid 104 can remain separate from the four main body panels in some embodiments until assembly.

To assemble the parcel delivery locker 100, the four main body panels 110, 112, 114, 116 can first be oriented vertically, and joining section 118 positioned such that the openings 132 through the joining section 118 align with corresponding openings 134 in the rear panel 114. The openings 132, 134 include a vertical series of openings. FIG. 2B shows a bottom view of the panels of the body portion 102. Note how joining portion 118 overlaps a portion of the rear panel 114; openings 132 in the joining portion are aligned with corresponding openings 134 in the rear panel 114. Once the openings 132, 134 are aligned, then fasteners such as fastening pegs can be inserted through the openings 132, 134 and are used to fasten the joining section 118 to the rear panel 114, as will be described. Likewise, the floor panel 108 includes sections 120, 122, and 124 which each fold in a hinged manner relative to the major portion of the panel 108, and which each have openings that align with corresponding openings along the bottom of the side and rear panels 110, 112, 114. The floor panel 108 can be hingeably joined to the front panel 116 along edge 156, and the bottom of the front panel 116. Sections 120, 122, 124 are then raised at a right angle to the major portion of the floor panel 108, and the openings in section 120 will align with corresponding openings 130 at the bottom of the left side panel 110, the openings in section 122 will align with corresponding openings 128 at the bottom of the rear panel 114, and openings in section 124 will align with corresponding openings at the bottom of the right side panel 112. Once these openings/sections are aligned, then fastening pegs or equivalent fasteners can be inserted through each aligned pair of openings. The lid 104 is attached in a similar manner; section 142 of the lid 104 includes openings 144 that align with openings 146 across the top of the rear panel 114 which are then fastened together by inserting fastening pegs into each aligned pair of corresponding openings. The lid 104 further include locking latch members that alternatively pass through or clear latch openings 136, 138, 140 in the right side panel 112, front panel 116, and left side panel 110, respectively, as will be described in further detail herein. The seal 106 is fitted over the top of the body portion 102 to create a water seal and exclude water from the interior of the parcel delivery locker 100 when the lid 104 is closed.

Figure 2A:
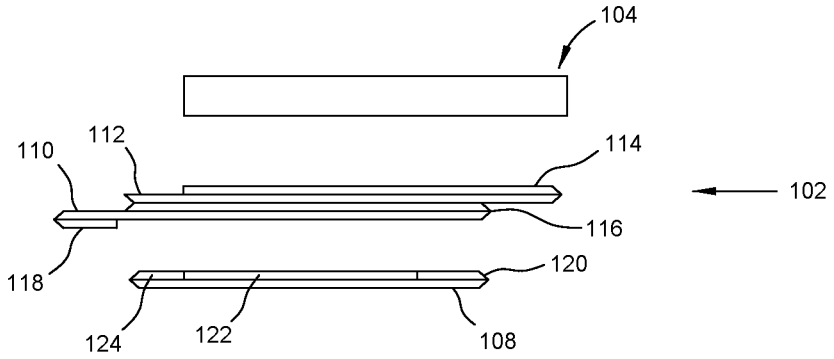
FIG. 2A is an end view of a parcel delivery locker in a folded configuration for shipment, prior to assembly, in accordance with some embodiments.
Figure 2B:
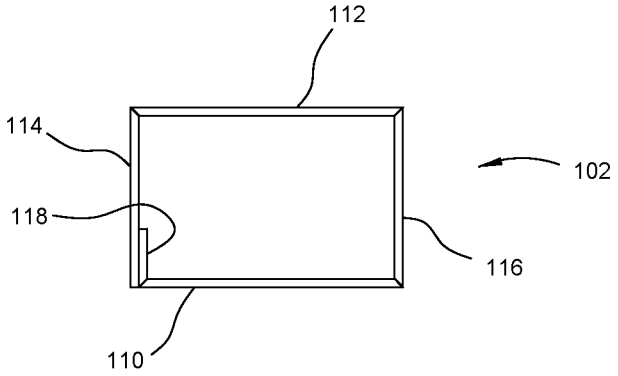
FIG. 2B is a bottom view of an assembled main body portion of the parcel delivery locker, in accordance with some embodiments.

FIG. 2A is an end view of a parcel delivery locker 100 in a folded configuration for shipment, prior to assembly, in accordance with some embodiments. An advantage to arranging the panels to be hinged together along their edges is that the panels of the body portion 102 can be folded into a stack. Likewise joining sections 120, 122, and 124 of the floor panel 108 can be folded over the major portion of the floor panel. The lid 104 can be stacked on top (or bottom) of the folded body portion 102. In order to arrange the panels 110, 112, 114, 116, and joining section 118, into a stack as shown, different hinge configurations are used between the panels so that some fold in one direction and others can fold in both directions in order to stack the panels in a folded arrangement. At least one of the hinge joints must allow movement of the panels over a range of two hundred seventy degrees in order to form the stack. As shown here the hinge joints connecting panel 114 to panel 112, and the hinge joint connecting panel 116 to panel 110 are both arranged to allow movement of the respective panels relative to each other over a range of two hundred seventy degrees about the hinge joint (e.g. the bore and hinge pin axes). Likewise, the hinge joint connecting jointing member 118 to panel 110 is also configured to allow 270° movement. By folding and stacking the panels of the body portion 102, with the lid 104 and floor 108 the parcel delivery locker 100 occupies minimal volume for shipping. Shipping fully assembled lockers would mean most of the volume occupied by the lockers would be air. By folding and stacking the various portions together, the volume occupied by the parcel delivery lockers 100 is minimized both in bulk shipments (e.g. to warehouses) and in individual shipments to end users.

Figure 3:
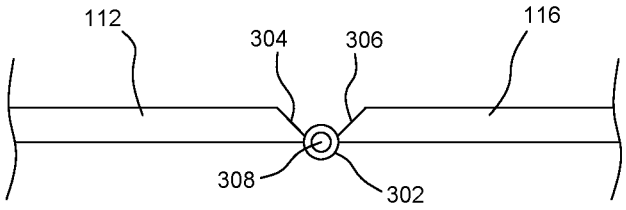
FIG. 3 is an end view of a hinge section connecting two panels of the parcel delivery locker in a flat configuration, prior to assembly, in accordance with some embodiments.
Figure 4:
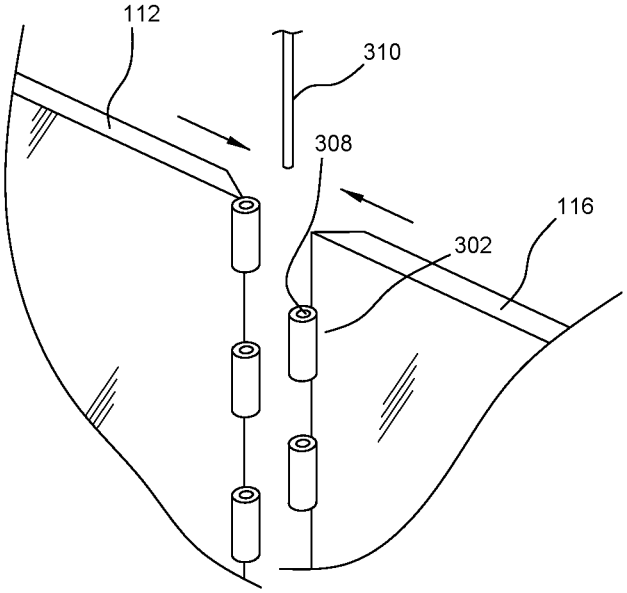
FIG. 4 is a partial perspective view showing a structure for connecting foldable panels of a parcel delivery locker, in accordance with some embodiments.
Figure 5:
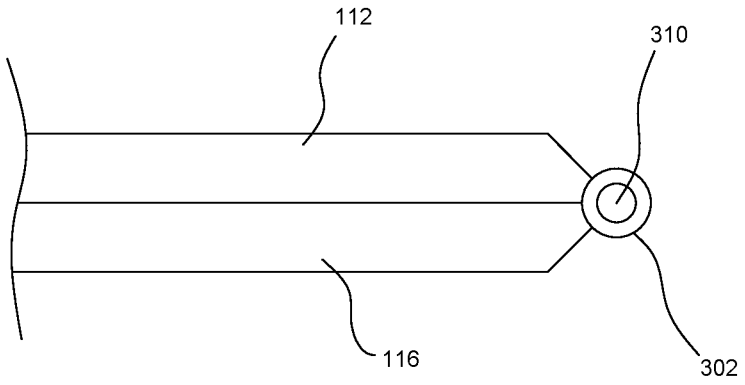
FIG. 5 shows an end view of connected panels using the structure of FIG. 4 in a folded configuration, in accordance with some embodiments.

FIG. 3 is an end view of a hinge section connecting two panels 112, 116 of the parcel delivery locker main body portion in a flat configuration, as shown, for example, in FIG. 1, prior to assembly, in accordance with some embodiments. In particular the view shows the front panel 116 and the right side panel 112 looking at their top end, in a direction perpendicular to the plane of their major surfaces (e.g. the sides). The panels 112, 116 are shown substantially as they appear in FIG. 1, with the view here being at a right angle to that of FIG. 1. Each of the panels 112, 116 have, along their vertical edges where the panels 112, 116 meet, alternating hinge barrels or knuckles 302 that have a bore 308 through them. The hinge knuckles 302 are substantially cylindrical and oriented such that the axis of the bore 308 is parallel with the vertical edges of the panels 112, 116. To provide relief for the panels 112, 116 to articulate relative to each other about the hinge bore 308, relief chamfers 304, 306 are cut at substantially a forty five degree angle at the edge of each panel 112, 116, respectively. As shown in FIG. 4, the panels 112, 116 can be moved together such that the hinge knuckles 302 interleave, aligning the bore 308 through each of the hinge knuckles 302 such that a hinge pin 310 can be inserted through the bore 308 of all of the hinge knuckles 302. This can allow the panels to be moved about the hinge pin 310/bore 308 such that panels 112, 116 can be positioned at a substantially right angle to each other, as shown in FIG. 2B, but also allows the panels 112, 116 to be folded against, and parallel to each other as shown in FIG. 5 so that the panels can be folded into a stack as shown in FIG. 2A, which is a total range of about two hundred seventy degrees of motion. In order to achieve this arrangement, the hinge knuckles 302 have to be located such that they extend from the panels 112, 116 beyond the end/edge of the panels 112, 116, and offset at about a forty five degree angle. The center of the bore 308 is in line with the plane of the relief faces 304, 306 of each of the panels 112, 116. That is, the plane of the relief faces 304, 306 passes through the center of the bore 308. If the hinge knuckles 302 were positioned along the edges of the panels, without being offset to the outside of the panels 112, 116 as shown, then the panels could only articulate about one hundred eighty degrees with respect to each other, and could not achieve both the folded configuration of FIG. 2A, the flat configuration of FIG. 5, as well as the assembled configuration of FIG. 2B, which requires about two hundred seventy degrees of movement.

Figure 6:
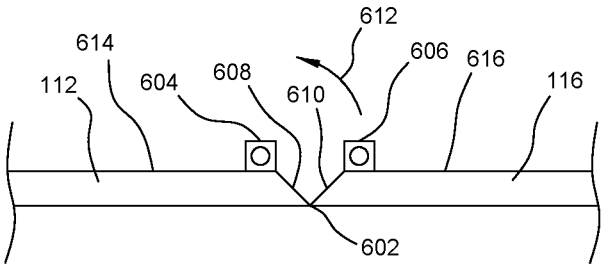
FIG. 6 shows a partial end view of connected panels for a parcel delivery locker in a flat configuration, and a structure for connecting the panels, in accordance with some embodiments.
Figure 7:
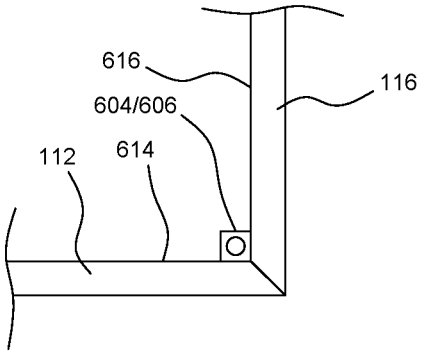
FIG. 7 shows a partial end view of connected panels for a parcel delivery locker in an assembled configuration, and a structure for connecting the panels, in accordance with some embodiments.
Figure 8:
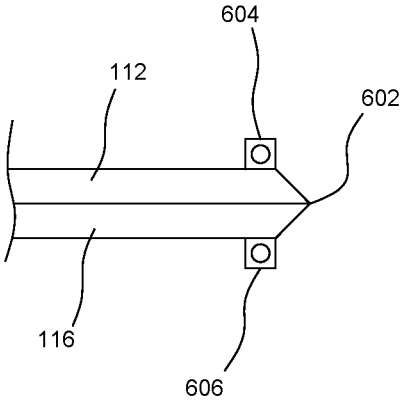
FIG. 8 shows a partial end view of connected panels for a parcel delivery locker in a folded configuration, and a structure for connecting the panels, in accordance with some embodiments.

FIG. 6 shows a partial end view of connected panels 112, 116 for a parcel delivery locker in a flat configuration, and an alternate structure for connecting the panels, in accordance with some embodiments. In this arrangement the panels 112, 116 are connected along their respective vertical edges by either a tape or a thin portion of the material of the panels 112, 116. That is, for example, panel 112 can have a relief 608 that is at an angle to the major surface 614, and panel 116 can likewise have a relief 610 that is at an angle to the major surface 616 of panel 116. The angle between these reliefs 608, 610 is about ninety degrees, allowing the two panels to be moved, as indicated by arrow 612, from the configuration shown here where the major surfaces 614, 616 are co-planar, to that of FIG. 7 where they are at a right angle to each other. However, the fact that the panels 112, 116 are connected by a thin section of material or a tape, also allows the panels 112, 116, to be positioned as shown in FIG. 8, in a folded/stacked arrangement.

Figure 9:
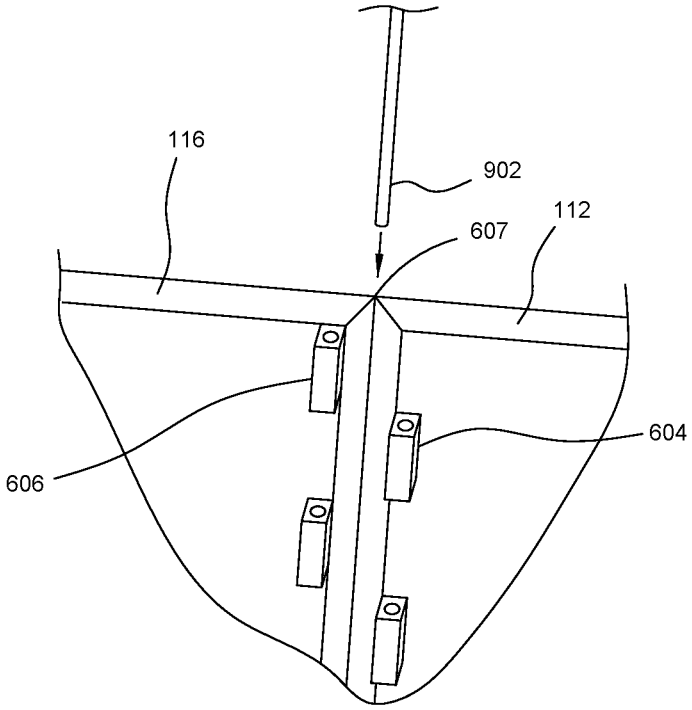
FIG. 9 shows a partial perspective view of connected panels for a parcel delivery locker in a flat configuration, and a structure for connecting the panels, in accordance with some embodiments.
Figure 10:
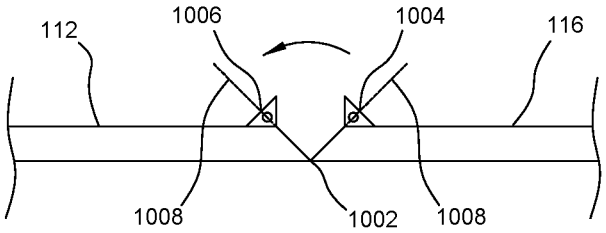
FIG. 10 shows a partial end view of connected panels for a parcel delivery locker in a flat configuration, and a structure for connecting the panels, in accordance with some embodiments.
Figure 11:
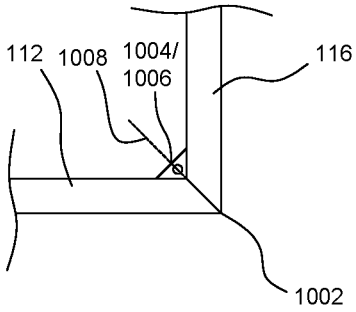
FIG. 11 shows a partial end view of connected panels for a parcel delivery locker in an assembled configuration, and a structure for connecting the panels, in accordance with some embodiments.
Figure 12:
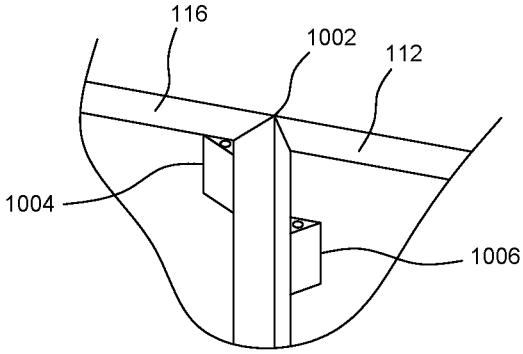
FIG. 12 shows a partial perspective view of connected panels for a parcel delivery locker in a flat configuration, and a structure for connecting the panels, in accordance with some embodiments.

To hold the panels 112, 116 together, hinge knuckles 604, 606 can be provides on panels 112, 116, respectively, in an alternating arrangement, as shown in FIG. 9. The hinge knuckles 604, 606 are an alternative to hinge knuckles 302, and hinge knuckles 604, 606 likewise include a bore through them to receive a hinge pin 902 when the panels are positioned as shown in FIG. 7. In particular, the center of the bore through each of the hinge knuckles 604, 606 lies on a line along the faces of the reliefs 608, 610. That is, if the planes of the relief faces 608, 610 were extended they would pass through the centers of the bores in knuckles 604, 606. In this arrangement of FIGS. 6-9 the hinge knuckles 604, 606 have a square cross section that is seen when they are viewed in a direction from the top or bottom ends of the panels. FIGS. 10-12 show a similar arrangement but where the hinge knuckles 1004, 1006 have a triangular cross section, and the panels can be joined along edge 1002. When the panels 112, 116 are moved the position shown in FIG. 11, the triangular hinge knuckles form a fillet along the inside corner formed by panels 112, 116. Again, the center of the bore through each of the hinge knuckles 1004, 1006 is located on a line 1008 that extends along the plane of the relief faces. It should be appreciated that in the arrangement of FIGS. 3-5 hinge knuckles 302 actually form a hinge. That is, once the hinge pin is inserted through the hinge knuckles 302, the panels can still move with respect to each other. However, in the arrangements of FIGS. 6-12, the hinge knuckles act to lock the panels in place, and they do not act like hinge.

Figure 13:
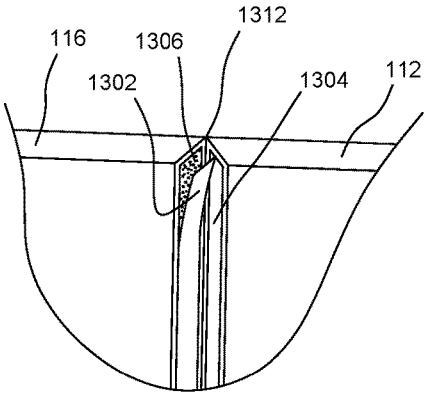
FIG. 13 shows a partial perspective view of connected panels in a flat configuration in which adhesive is used to join the panels in their assembled configuration, in accordance with some embodiments.
Figure 14:
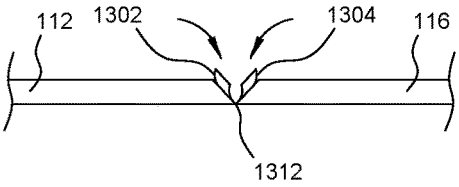
FIG. 14 shows a partial end of connected panels in a flat configuration in which adhesive is used to join the panels in their assembled configuration, where the adhesive liner is being removed from each panel, in accordance with some embodiments.

FIG. 13 shows a partial perspective view of connected panels 112, 116 in a flat configuration in which adhesive is used to join the panels in their assembled configuration, in accordance with some embodiments. Again, the panels 112, 116 can be joined along their vertical edge 1312 by thin section of material that allows the two panels to articulate with respect to each other. Each of the panels has a relief formed at about a forty five degree angle, creating corresponding surfaces that come together when the panels 112, 116 are moved into the configuration of FIG. 15A. These surfaced can be covered with an adhesive 1306 that is in turn covered by a liner 1302, 1304 that can be peeled off, as indicated in FIG. 14, immediately prior to assembly of the body portion 102 of the parcel delivery locker 100. The adhesive 1306 can be a binary adhesive where one constituent is under liner 1302, and a second constituent is under line 1304, and when the two adhesive constituents come together and make contact with each other, they mix and form an adhesive that can harden. Examples of such binary adhesives include various epoxy constituents. The adhesive 1306 can be used alone, or with hinge knuckles, e.g. 1308, 1310 for additional strength.

FIGS. 15B and 15C show a partial end view of connected panels in a folded configuration (FIG. 15B) and in an assembled configuration (FIG. 15C) that are hinges at the internal side of the joint, and the joining structures (hinge knuckles) on the outside, in accordance with some embodiments. Again, using panels 112, 116 as examples, panels 116 has knuckles 1502 that include a bore 1504, and panel 112 has knuckles 1508 that have a bore 1506. The knuckles 1502 alternate with knuckles 1506 along the vertical edges of the panels 112, 116 so that when the panels are moved, as indicated by arrow 1510, to the configuration of FIG. 15C, the bores are aligned and a hinge pin can be used to secure the panels' positions. In this case the panels 112, 116 are joined by a thin section 1512 that acts as a hinge. Further, the faces of the relief sections that make contact can be provided with adhesive as in FIGS. 13-14.

FIGS. 15D-15G show views of connected panels for a parcel delivery locker in which the joining structures of each panel alternate and fit into corresponding recesses in the adjacent panel, in accordance with some embodiments. In particular, again using panels 112, 116 as examples, the panels 112, 116 are connected by a thin section of material 1518 along their common vertical edge, and specifically along an inner vertical edge that will be innermost to the parcel delivery locker when the body portion 102 is assembled. Each of the panels 112, 116 have sections 1522, 1524 that extend beyond section 1518 and which form a ninety degree notch that closes when the panels are moved, as indicated by arrow 1520 to the configuration of FIG. 15E. Each panel 112, 116 also has alternating knuckles 1514 and recesses 1516. The knuckles 1514 of one panel fit into the corresponding recess 1516 of the other panel in the configuration of FIG. 15D. Then when moved to the configuration of FIG. 15E, the bores of the knuckles of each panel are aligned to receive a pin. Note that the pin will only be accessible from inside the assembled parcel delivery locker (e.g. when the lid is opened), which prevents unauthorized people from removing the pin in an attempt to access the inside of the parcel delivery locker. FIG. 15F shows a perspective view of panel 116 detached from panel 112, and the knuckles 1514 and recesses 1516 can be seen to alternate along the vertical edge of the panel 116. The recesses 1516 on panel 116 accommodate the knuckles of panel 112, for example, when the panels are arranged as in FIG. 15D. FIG. 15G shows a cross sectional view taken along section line B-B' and it can be seen that the bore through the knuckle 1514 is on a line 1534 that extends from the plane of the face 1530 of the relief which is at about a forty five degree angle to the plane of the major surfaces (e.g. outside surface 1532) of the panel 116. The recess 1516 accommodates a corresponding knuckle of the adjacent panel when the panels are folded in a stacked arrangement (e.g. as in FIG. 15D).

Accordingly there are a variety of structures for joining the panels 110, 112, 114, and 116 together which allow the panels of the body portion 102 to be stacked for shipment, meaning arranged in coplanar orientations and grouped together. The simplest arrangement is to form the panels to have corner reliefs and thin connecting sections of material along their vertical edges that allow the panels to move relative to each other due to the flexibility of the material. A tape member can be used to reinforce the vertical edges, or even to replace the thin connecting sections when the panels are completely separate from each other. The tape member need not be completely adhesive. In other, or additional arrangements, interleaving knuckles can be used on the panels to receive a pin through the knuckles that holds the panels together. The knuckles and pin can, in some configurations, operate as a hinge, and in other configurations are used only to lock the panels in their assembled arrangement/positions. In some arrangements the panels can use adhesive to hold the panels in their assembled configuration, and the adhesive be provided on the panel reliefs and covered with liners that can be removed to allow the adhesive to hold the relief faces together. By providing the parcel delivery locker in a stacked configuration the volume of space required for shipping is greatly reduced over that of an assembled locker and it allows the end user to easily assemble the body portion 102.

The four panels of the body portion 102 can be joined together using hinge joints. There can be, for example, a first hinge joint along the adjacent vertical edges of the rear panel 114 and the right side panel 112, a second hinge joint along the adjacent vertical edges of the right side panel 112 and the front panel 116, a third hinge joint along the adjacent vertical edges of the left side panel 110 and the front panel 116, and a fourth hinge joint along the adjacent vertical edges of the left side panel 112 and the rear panel 114. The further hinge joint can be between the left side panel 110 and a joining portion 118 that fastens to the rear panel 114. Preferably, the panels are connected together prior to shipping to the end user. At least one of the hinge joint allow a range of motion of at least two hundred seventy degrees in order to allow the panels to be arranged in a stack configuration as well as in a box configuration.

Figure 16:
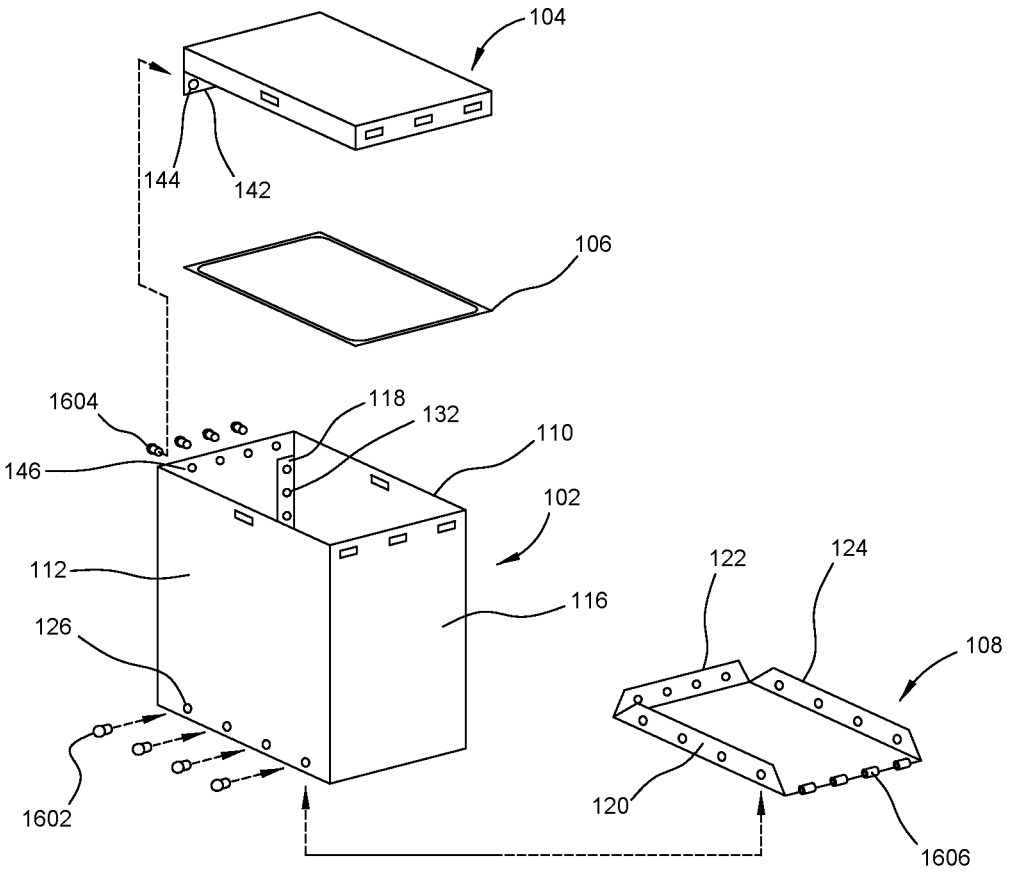
FIG. 16 shows an exploded perspective view of parcel delivery locker in which the lid is being assembled onto a partially assembled body, in accordance with some embodiments.

FIG. 16 shows an exploded perspective view of parcel delivery locker in which the lid 104 and the floor 108 are being assembled onto a partially assembled body 102, in accordance with some embodiments. Once the body 102 is configured into the square/rectangular configuration, then the body can be secured in that configuration using fastening pegs 1602, 1604. The fastening pegs pass through the openings in the aligned panels where two panels or a joining section and a panel overlap. For example, joining section 118 overlaps with the rear panel 114, and openings 132 in the joining section 118 align with corresponding openings 134 in the rear panel 114. A fastening peg is placed through each set of aligned openings 132, 134. Likewise, the floor 108 is attached by aligning openings in sections 120, 122, 124 of the floor 108 with corresponding openings (e.g. 126) in the side and rear panels 110, 112, 114. The floor 108 can also be coupled to the front panel in a similar arrangement, or use the interleaving knuckle arrangement that is used along the vertical edges of the panels. Likewise, the lid 104 has a section 142 with openings 144 that align with corresponding openings 146 along the top of the rear panel 114. Fastening pegs can be placed through all such aligned pairs of openings.

Figure 17:
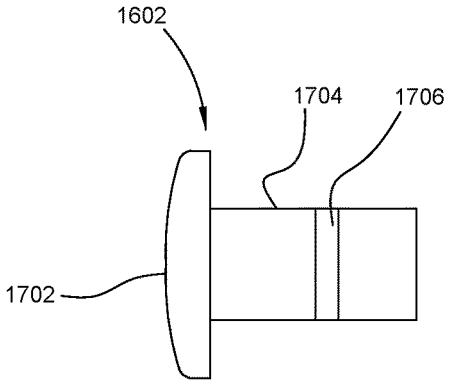
FIG. 17 shows a first side view of a fastener for assembling a parcel delivery locker, in accordance with some embodiments.
Figure 18:
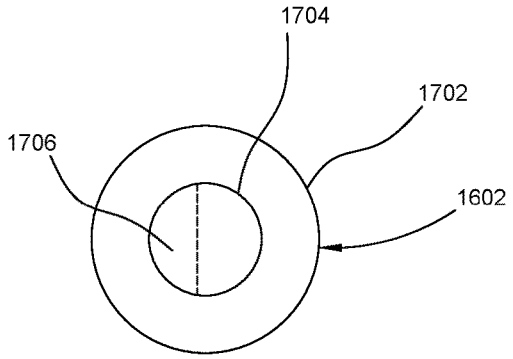
FIG. 18 shows an end view of the fastener of FIG. 17.
Figure 19:
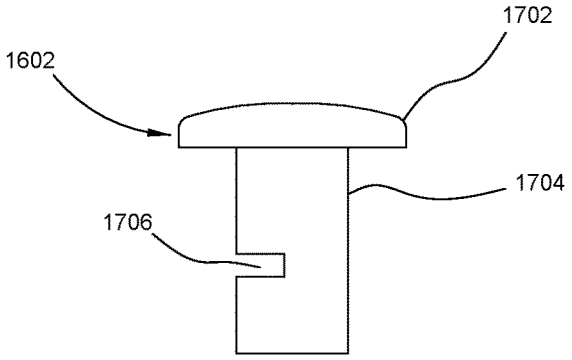
FIG. 19 shows a second side view of the fastener of FIG. 17 with the fastener rotated ninety degrees.
Figure 21:
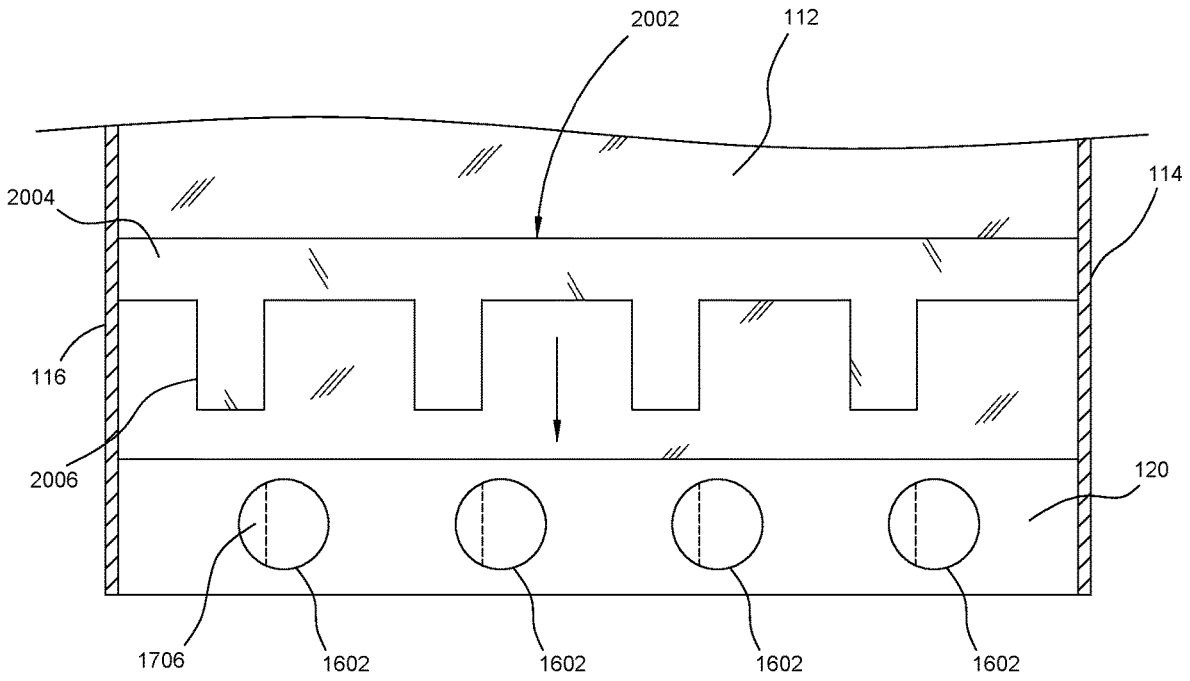
FIG. 21 shows a partial sectional side view taken from the inside of a parcel delivery locker being assembled in which a retaining member is being moved into engagement with a row of fasteners, in accordance with some embodiments.
Figure 22:
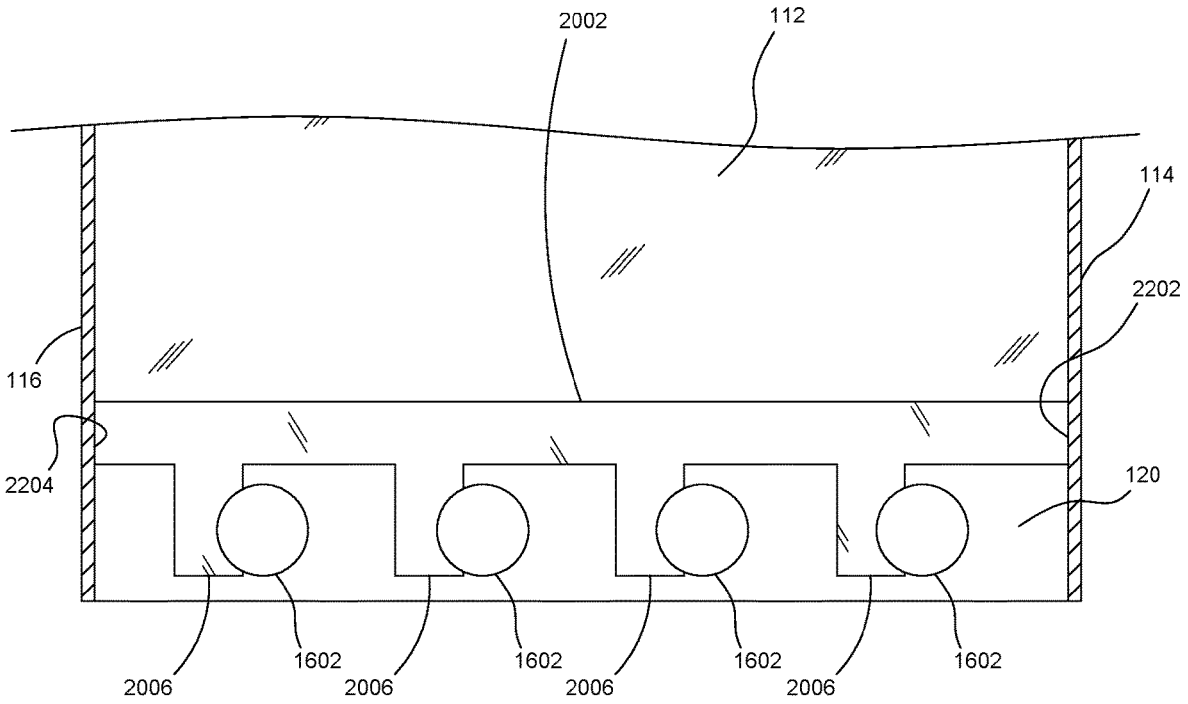
FIG. 22 shows a partial sectional side view taken from the inside of a parcel delivery locker being assembled in which a retaining member is engaged with a row of fasteners, in accordance with some embodiments.

The fastening pegs 1602 are fasteners, and are shown in FIGS. 17-19, with FIG. 17 showing a first side view, FIG. 18 showing an end view, and FIG. 19 showing a second side view of the fastening peg of FIG. 17 with the fastener rotated ninety degrees. The fastening pegs have a head 1702 at one end of a shaft 1704. The shaft 1704 can be cylindrical, or have flattened side(s). If the shaft 1704 has one or more flat sides along its length, then the openings in the panels and joining sections can be shaped the same to "key" the shaft 1704 to a particular orientation. A recess or notch 1706 is formed in the shaft 1706, preferably near the end of the shaft 1704 opposite the head 1702. The head 1702 prevents the fastener from being pushed through the openings in the panels/joining sections. The recess is cut into the shaft 1704 generally perpendicularly to the lengthwise axis of the shaft 1704. The recess 1704 is sized to receive a portion of a stub of a retaining member, as shown in FIGS. 20-22.

Figure 20:
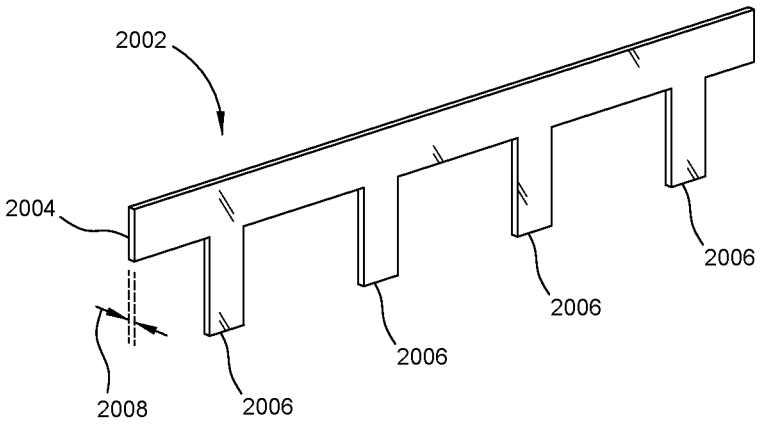
FIG. 20 shows a perspective view of a retaining member that locks fasteners such as that shown in FIG. 17 in place in an assembled parcel delivery locker, in accordance with some embodiments.

FIG. 20 shows a perspective view of a retaining member 2002 that locks fasteners 1602 such as that shown in FIG. 17 in place in an assembled parcel delivery locker, in accordance with some embodiments. FIG. 21 shows a partial sectional side view taken from the inside of a parcel delivery locker being assembled in which a retaining member 2002 is being moved into engagement with a row of fasteners 1602, and FIG. 22 shows a partial sectional side view taken from the inside of a parcel delivery locker being assembled in which a retaining member 2002 is engaged with a row of fasteners 1602, in accordance with some embodiments. The retaining member 2002 is used to hold the fasteners/fastening pegs 1602 (or 1604) in place, and includes a main body 2004 from which several stubs 2006 extend. The retaining member has a thickness 2008 that is substantially equal to the width of the recess 1706 in the fasteners 1602. As shown in FIG. 21, the retaining member 2002 has a length that is substantially equal to the width of the panel against which is it seated. For example, here the retaining member 2002 is against the inside of panel 112, between panels 114 and 116. The length can be slightly more than the width of panel 112 so as to bear against panels 114, 116 at the ends of the retaining member 2002 for a friction/interference fit that holds the retaining member 2002 substantially in place. Each of the fasteners 1602 are oriented so that the recess 1706 of each fastener is oriented to a corresponding stub 2006. The retaining member 2002 can be positioned to one side of the row of fasteners 1602 each pass through openings along the bottom of side panel 112 and the corresponding openings in the joining section 120 of the floor 108. In FIG. 22 the retaining member 2002 has been moved downward so that the stubs 2006 each engage and sit in a corresponding recess 1706 of a fastener 1602. In this position the fasteners 1602 cannot be withdrawn from the openings because they are retained by the interference of the stubs 2006 in the recesses 1706. The retaining member 2002 presses against the panels 114, 116 at locations 2202, 2204 at the opposite ends of the retaining member 2002 to hold the retaining member in place. Adhesive or tape can also be added to hold the retaining member 2002 in place.

Figure 23:
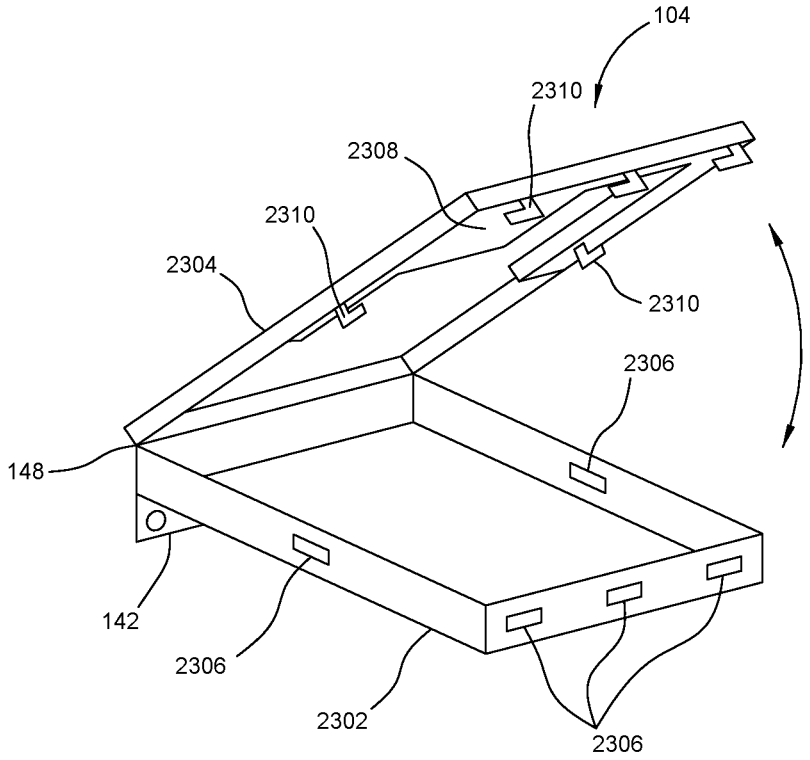
FIG. 23 shows a perspective view of a lid for a parcel delivery locker, in accordance with some embodiments.
Figure 24A:
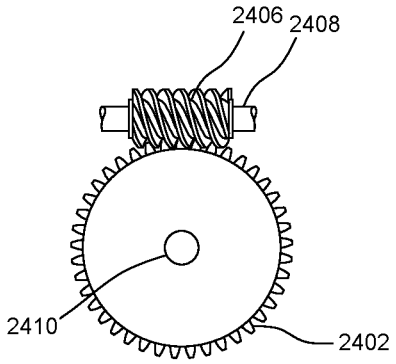
FIG. 24A shows a top view of a gearing arrangement to drive locking tabs of a lid for a parcel delivery locker, in accordance with some embodiments.
Figure 25:
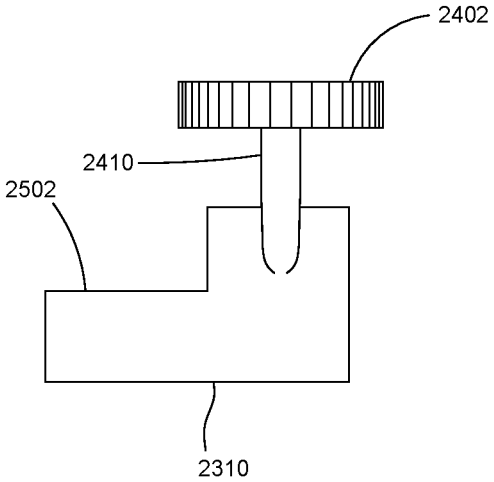
FIG. 25 shows side view of a locking tab for a lid of a parcel delivery locker, in accordance with some embodiments.
Figure 26:
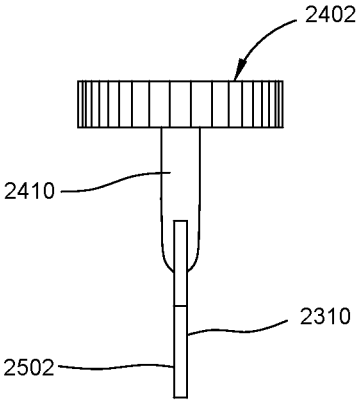
FIG. 26 shows a front view of a locking tab for a lid of a parcel delivery locker, in accordance with some embodiments.
Figure 24B:
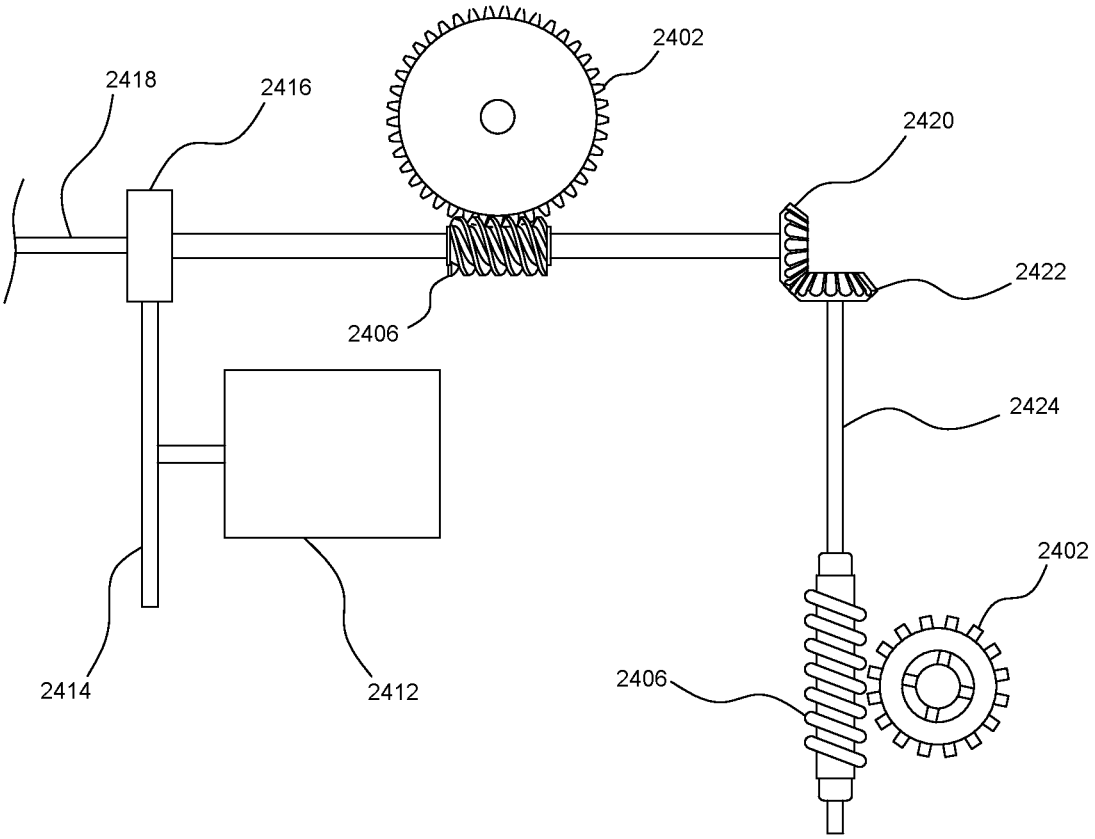
FIG. 24B shows a top view of a drive arrangement using the gearing arrangement to drive locking tabs of a lid for a parcel delivery locker, in accordance with some embodiments.

FIG. 23 shows a perspective view of a lid 104 for a parcel delivery locker, in accordance with some embodiments. The lid 104 includes a skirt 2302 and the lid panel 2304. The lid panel is attached to the skirt 2302 at a hinge joint 148. the skirt can fit on the inside or on the outside of the top of the body portion 102, and include tap openings 2306 that align with corresponding to openings 136, 138, 140 on panels 112, 116, 110, respectively (see FIG. 1). The skirt 2302 can have a joining section 142 that uses openings to receive fasteners similarly to the arrangement used to connect the floor 108 to the body portion 102. Housed in the lid panel 2304 is a control circuit and control mechanism 2308, which includes both circuitry for operating the various electrical and electronic systems as well as the electromechanical system that controls the latching of the lid to the body. In particular, there are a series of locking tabs 2310 that extend downward from the lid, and have an "L" shape. Referring also to FIGS. 24A-26, these locking tabs are controlled to turn on a vertical axis (relative to when the lid is closed) defined by a shaft 2410 that is coupled to a horizontal gear 2402. The lower portion of each locking tab 2310 is a horizontal extension 2502. A network of shafts 2408 extends around the inner portion of the lid and are rotated about their axes; at each locking tab there is a worm gear 2406 that engages and turns the horizontal gear 2410. At the corners of the lid, the shafts intermesh with gears oriented at right angles to each other to carry to rotation to the sides. In FIG. 24 B there is shown an arrangement that can be used to drive the locking tabs 2310. A motor 2412 is controlled by a control circuit to drive a main gear 2414 to turn in one direction to unlock the locking tabs or lock them. The main gear is mated to a drive gear 2416 on a shaft 2418 that turns in response. The shaft 2418 includes one or more worm gears 2406 that drive the horizontal gears 2402 of each locking tab 2310. To impart the drive torque to the sides, a pair of angled gears 2420, 2422 are mated to cause a shaft 2424 that runs along the side of the lid to drive one or more worm gears 2406, and an associated horizontal gear 2402 of a locking tab 2310. Shaft 2418 can be disposed on the inside of the lid at the front, and drive locking tabs 2310 to selectively engage with, or disengage from, tab openings 2306. Shaft 2424 can be likewise disposed in the lid along a side panel, and another shaft parallel to shaft 2424 on the opposite side can be used to drive one or more locking tabs on the other side of the lid.

Figure 27:
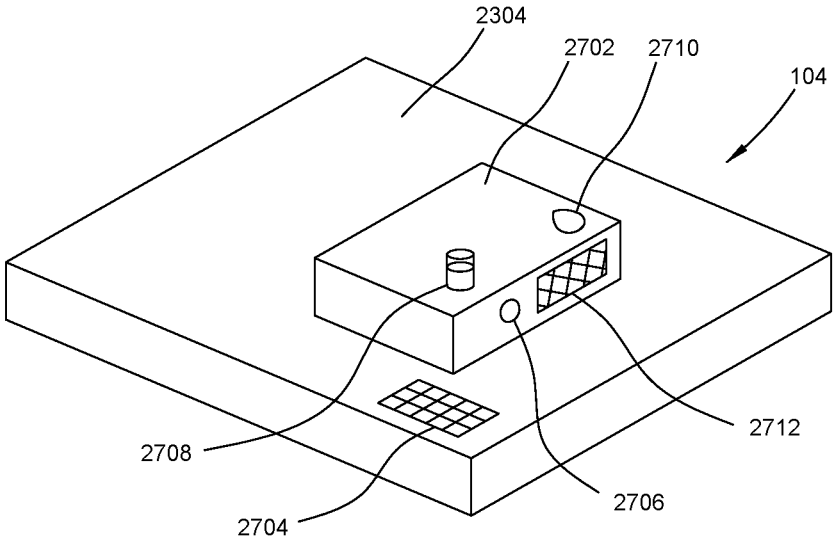
FIG. 27 shows a perspective view of a top of a lid for a parcel delivery locker, in accordance with some embodiments.

FIG. 27 shows a perspective view of a top of a lid 104 for a parcel delivery locker, in accordance with some embodiments. The lid 104 is provided with several electrical/electronic and electromechanical systems that are controlled and operated by circuitry and components in the lid 104. For example, the lid 104 can include a housing portion 2702 in which much of the circuitry and components are housed in the lid panel 2304. For example, there can be included a keypad 2704 to allow a user to operate the circuitry, including, for example, entering a code to unlock the lid 104 from the body portion 102, as well as to input commands and option selections such as, for example, inputting a password for a WiFi access point. A display can be provided with the keypad 2704 so that the user can be presented with information and confirm that information being entered is correct. The lid 104 can also include a proximity sensor 2706 that detects motion, such as when a person walks toward the parcel delivery locker. The proximity detector 2704 can be used to trigger a camera 2708, which can be either a conventional wide angle camera that records images and video, or a 360° panoramic camera that captures images and/or video in a complete circle around the parcel delivery locker. The camera 2708 is shown here on the top housing portion 2702 but can be located on the front of the housing portion 2702 as well (i.e. next to proximity sensor 2706). In some embodiments a fingerprint reader 2710 can be included for fast unlocking of the lid, rather than having the user enter a code at the keypad 2704. The user can simply swipe their finger across the fingerprint reader, and circuitry will receive data describing the fingerprint that can be compared to a stored record of the user's fingerprint to determine there is a match. Further, there can be audio components 2712 such as a speaker and a microphone to play and record audio. For example, a speaker can be used to play a siren/alert sound if the parcel delivery locker is being tampered with. Audio can be used to allow a user to communicate with a person in proximity to the parcel delivery locker.

Figure 28:
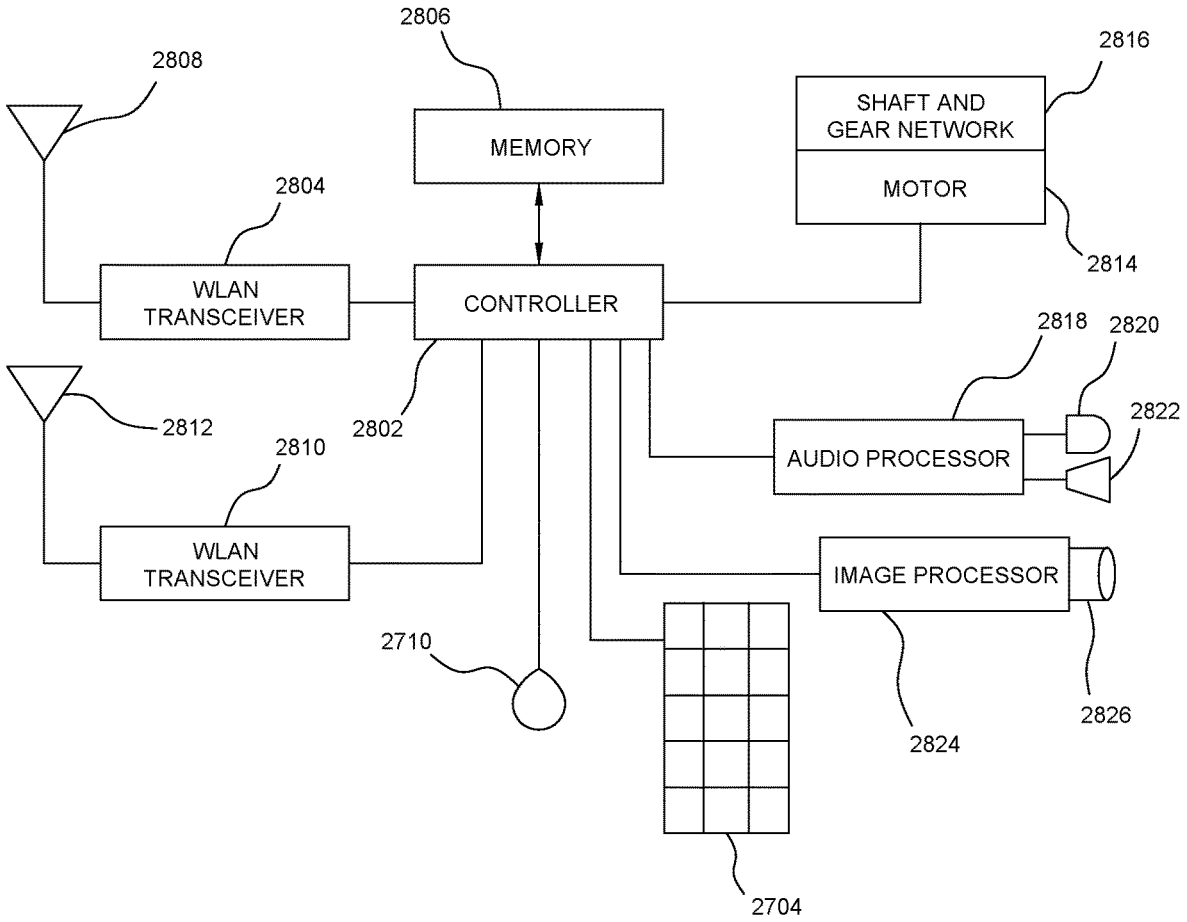
FIG. 28 shows a block schematic diagram of a lid for a parcel delivery locker, in accordance with some embodiments.

FIG. 28 shows a block schematic diagram of a lid for a parcel delivery locker, in accordance with some embodiments. The circuit elements shown here can be housing in the housing 2702 of the lid 104, and A controller 2802 can be a microprocessor that performs instruction code designed to operate the various components of the parcel delivery locker. Instruction code and various data can be stored and instantiated in memory 2806, which can include long term storage memory as well as random access memory (RAM). The system can include a wireless local area network (WLAN or WiFi) transceiver 2804 and associated antenna 2808. The WLAN transceiver can connect to the Internet via a wireless access point to allow audio, images, and video to be transmitted to some endpoint on the Internet, such as cloud storage, or a user's device. It is contemplated, for example, that, like common wireless doorbell units, the parcel delivery locker can be used to stream audio/video to a remote device, such as a user's smartphone device, via the Internet. Further, the owner/user of the parcel delivery locker can access data stored by the locker, such as when the locker was opened last and by whom. In addition, a personal area networking transceiver 2810 and associate antenna 2812 can be provided in order to allow a user access to the locker over a short range wireless networking link, such as BLUETOOTH. That is, for example, the user can use a near-range wireless link between the user's smartphone device and the PAN transceiver 2810 to lock or unlock the locker, access data in the memory 2806, change settings, etc. The PAN transceiver 2810, or the WLAN transceiver 2804, or an equivalent wireless transceiver, can be used to receive signals from a third party device, such as a delivery server device, which can transmit an authorization code to the locker, which in turn verifies the code and unlocks the lid so that the delivery person can place a parcel being delivered into the locker.

The processor further controls a motor 2814, which can be substantially equivalent to motor 2412 that drives a shaft and gear network 2816 to move the locking tabs between the locked and unlocked positions. This can includes the gears and shafts shown in FIG. 24B, for example. An audio processor 2818 is an audio circuit that can include an audio power amplifier to play an audio signal over a speaker 2822, and receive audio signals from a microphone 2820. The audio processor 2818 can convert digital audio information into an analog audio signal for playing over the speaker 2822, and similarly, analog audio can be received from the microphone 2820 and digitized for storage as an audio file. An image processor 2824 can be used to operate a digital camera 2826 and produce image and/or video data from ambient light incident on the camera 2826. And both a fingerprint reader 2710 and keypad 2704 can be provided as shown in FIG. 27. Other circuit components can be included, such as, for example, an accelerometer that can be used to sense mechanical shock, such as if the parcel delivery locker were being struck by something. A variety of alarm conditions can be defined to trigger a response to possible tampering, such as playing a siren or alarm audio over the speaker 2822.

The goal of the parcel delivery locker is not to be able to resist all attempts to gain access to the contents of the locker without authorization, but to impose a substantial enough burden on a would-be thief to discourage them from even trying. The first way this is accomplished is by simply concealing a parcel held inside the locker. If a thief cannot see if there is a parcel there that can be readily picked up and carried away, they are much less likely to approach a residence. Likewise, not knowing whether the locker contains any packages, and knowing that getting access will be more difficult, and further knowing they may be recorded on video and that the locker may begin to emit a loud alert/siren sound and draw attention, will discourage a thief from attempting to access the locker. To further discourage thieves, the locker can be mounted to a surface.

Figure 29:
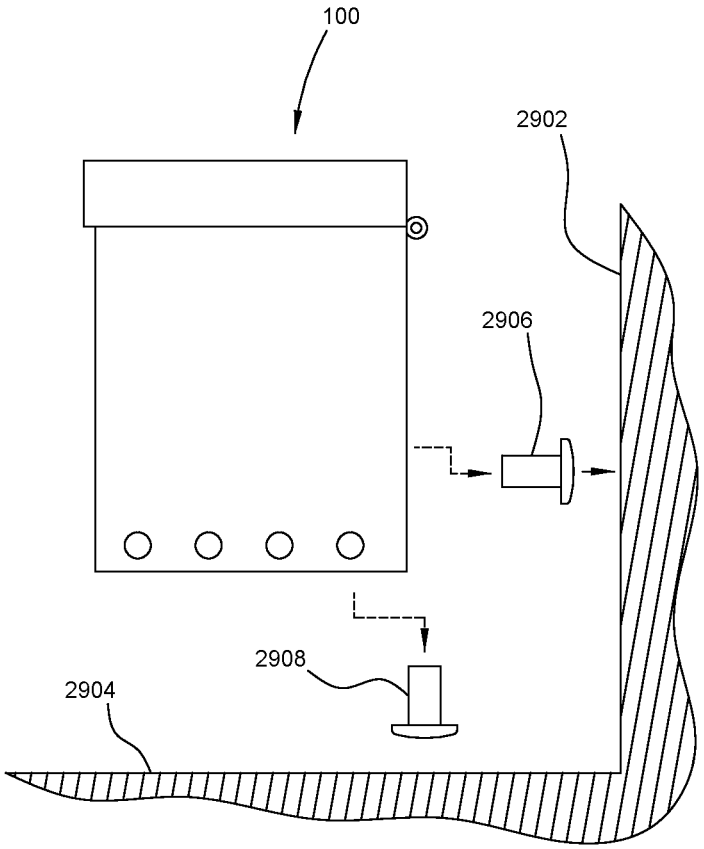
FIG. 29 shows a side view of a mounting system to mount a parcel delivery locker, in accordance with some embodiments.

FIG. 29 shows a side view of a mounting system to mount a parcel delivery locker 100, in accordance with some embodiments. The locker 100 can be mounted on a wall or door 2902, or on a floor 2904 near the door, such as on a porch or front step. Anchors 2906, 2908 can be fixedly attached to the wall 2902 or floor 2904, such as by a strong adhesive or by being bolted to those surfaces. The anchors can operate very similar to the fastening pegs used to assemble the locker, passing through openings in the rear or floor panels, or alternatively then can be threaded members that pass through the a panel (rear or floor) and receive a nut/washer to retain the locker. In some embodiments a "U" shaped mount can be sized to fit under a door provide an anchor on which to mount the locker 100. Most exterior doors have weather stripping at their bottom and can accommodate a mount having a thickness on the order of one eighth of an inch or so, which, if made of a strong material, would resist attempts to remove the locker by force, at least enough to substantially discourage thieves from attempting to do so.

Figure 30:
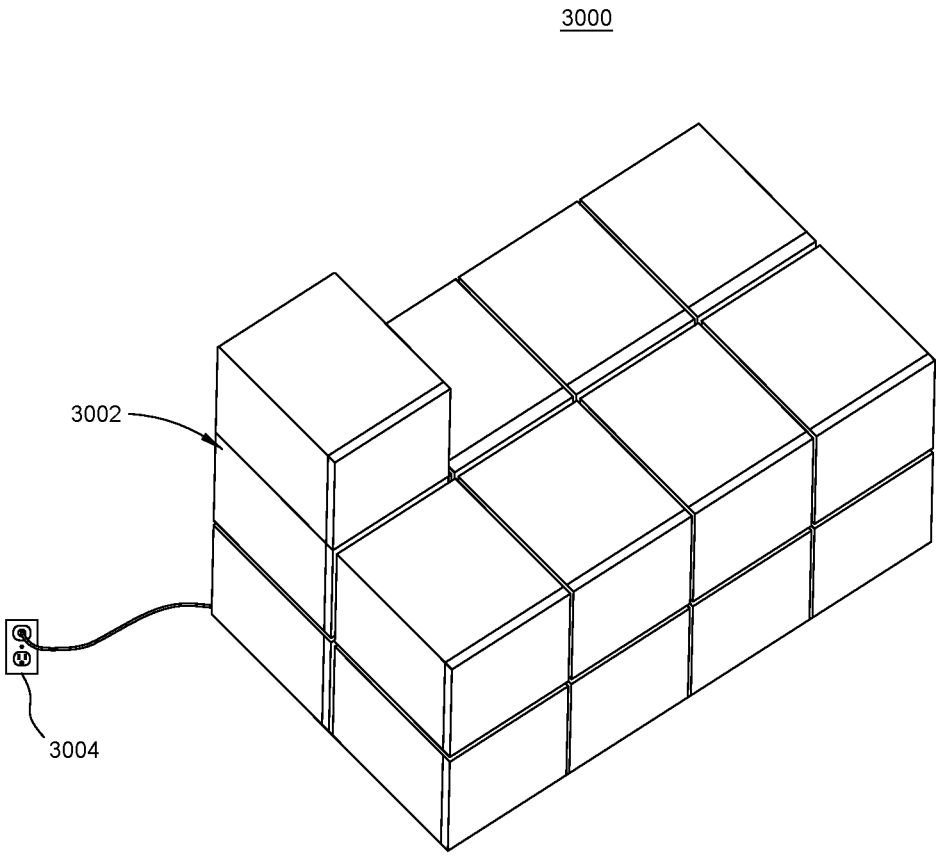
FIG. 30 shows a collection of parcel delivery lockers that a magnetically held to each other, and which form a common charging circuit in their collected configuration, in accordance with some embodiments.

FIG. 30 shows a collection of parcel delivery lockers 3000 that are magnetically held to each other, and which form a common charging circuit in their collected configuration, in accordance with some embodiments. It is contemplated that the circuitry of the locker can be operated by a rechargeable battery. In some embodiments, a plurality of assembled lockers 3000 can each have magnetic elements that magnetically mate with corresponding magnetic elements on similarly oriented, and adjacently positioned lockers. The these magnetic elements can be located with electrical connector elements so that electricity can flow through the lockers in parallel. A standard electrical outlet 3004 can provide enough electrical power to recharge several batteries at the same time.

Figure 31:
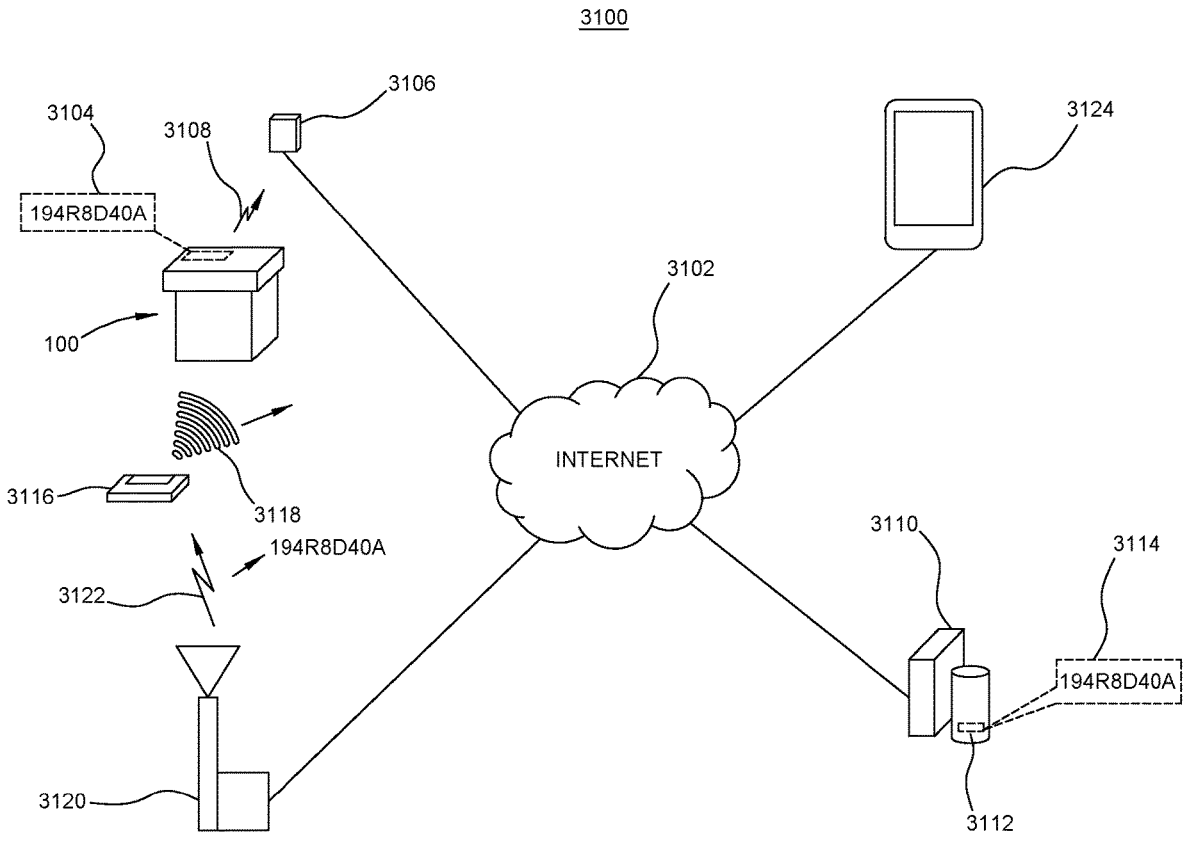
FIG. 31 shows a system for online commerce in which goods are delivered to a user after being ordered online, and in which a parcel delivery locker is used, in accordance with some embodiments.

FIG. 31 shows a system 3100 for online commerce in which goods are delivered to a user after being ordered online, and in which a parcel delivery locker is used, in accordance with some embodiments. The system includes a parcel delivery locker 100 at a user's premises. The user can use a device, such as a smartphone device 3124 to order something over the internet 3102 from an online merchant that operates a data center including a server 3110 and database 3112. The user can browse products and pay for selected items, which are then sent to the user's premises for delivery. The locker can have an authorization code 3104 that acts like a password. When the user places the order, the user can provide the authorization code to the merchant where it is stored as a record 3114 in the database 3112 in association with the order. When the delivery person arrives at the premises, a device 3116 can receive a copy of the authorization code from the merchant via a cellular network 3120, as indicated in signal 3122. The device 3116 can then transmit the authorization code in signal 3118 to the locker 100, after a handshake operation to connect the device 3116 to the locker 100 using the wireless network transceiver of the locker 100. If the code is correct, then the locker 100 can unlock the lid, allowing the delivery person to place the parcel inside the locker 100, and upon closing the lid, the lid will lock itself again. After receiving the delivery, or while the delivery is being made, the locker 100 can also stream video and audio to a nearby wireless access point 3106 that is routed to the user's smartphone device 3124. In an alternative embodiment, the code can be generated by the merchant (i.e. an order number), and transmitted to the user (the user's device), and then the user or the user's device provides the code to the locker. In that way, each code is used once, and no two merchants use the same code. This can also be used to inform the user which order has been delivered as the locker can transmit the code to the user's device 3124 (which can also be a computer) that cross references the code with orders. The code 3104 can also be assigned to the locker 100, such as upon manufacture of the box.

A parcel delivery locker has been disclosed that can be alternatively configured in a stack configuration for shipping, or a box configuration or use in receiving and containing parcels. The locker include a body portion made up of four panels, including front and rear panels, and right and left side panels. These panels can be shipped in a stacked configuration and then assembled into a box configuration for use. The locker also includes a lid and a floor. The lid includes electronics that, among other things control the locking and unlocking of the lid to/from the body. The lid can also include a wireless networking transceiver, motion sensor, camera, speaker, and a microphone.

The claims appended hereto are meant to cover all modifications and changes within the scope and spirit of the present invention.

What is claimed is:

1. A parcel delivery locker, comprising:

a body portion having four side panels, the four side panels including a left side panel, a front side panel, a right side panel, and a rear side panel, wherein the front panel is hingeably joined to the right side panel and the left side panel, and one of the left side panel or the right side panel is hingeably joined to the rear panel such that the four side panels can be arranged alternatively in a stack or in a box configuration where the rear panel is joined to the other of the left or right panel that is not hingeably joined to the rear panel;

a lid that is configured to join to the body portion when the four panels are arranged in the box configuration, the lid including a joining portion that is configured to fasten to the rear panel and is hingeably joined to a main top portion of the lid, the lid including an electronically controlled locking mechanism that is operable to lock the top portion of the lid to the body portion; and a floor portion that is configured to be fastened to the four side panels at a bottom of each of the four side panels when the four side panels are arranged in the box configuration.

2. The parcel delivery locker of claim 1, wherein the lid further comprises a wireless networking transceiver that is configured to receive wireless commands to lock and unlock the lid from the body portion.

3. The parcel delivery locker of claim 1, wherein the one of the left side panel or the right side panel that is hingeably joined to the rear panel comprises a joining section that is hingeably joined to one of the left side panel or the right side panel, and wherein the joining section overlaps with a portion of the rear panel to receive fasteners that pass through both the joining section and the rear panel.

4. The parcel delivery locker of claim 1, wherein the floor portion comprises at least two joining portions that are hingeably joined to a main floor panel portion wherein the at least two joining portions are on opposite ends of the main floor panel portion and overlap with opposing ones of the four side panels, and wherein fasteners pass through the at least two joining portions and the side panels.

5. The parcel delivery locker of claim 4, wherein the fasteners are fastening pegs having a shaft and head, the shaft having a notch at a right angle to an axis of the shaft, and the parcel delivery locker further includes a retaining member having a portion that fits into the notch on each one of the fastening pegs at an inside of the parcel delivery locker.

6. The parcel delivery locker of claim 1, wherein the four panels are hingeably joined by a plurality of interleaving hinge knuckles along their respective vertical edges, and a hinge pin that passes through each of the plurality of interleaving hinge knuckles, wherein the vertical edges adjacent the interleaving hinge knuckles are chamfered at a forty five degree angle relative to a major surface of the panels.

7. The parcel delivery locker of claim 6, wherein the hinge knuckles are disposed on an inside surface of the panels.

8. The parcel delivery locker of claim 7 wherein the hinge knuckles have a square cross section.

9. The parcel delivery locker of claim 7 wherein the hinge knuckles have a triangular cross section.

10. The parcel delivery locker of claim 9, wherein the hinge knuckles fit into corresponding recesses on an adjoining panel.

11. A parcel delivery locker, comprising:

a body portion having four panels, the four panels including a front panel, rear panel opposite the front panel, a left side panel, and a right side panel, the left side panel and the right side panel positioned between the front and rear panels on opposite sides of the body portion, wherein the right side panel is joined to the rear panel along a first hinge joint along adjacent vertical edges of the rear panel and the right side panel, the right side panel is joined to the front panel along a second hinge joint along adjacent vertical edges of the front panel and the right side panel, the left side panel is joined to the front panel along a third hinge joint along adjacent vertical edges of the front panel and the left side panel, and the left side panel is joined to the rear panel along a fourth hinge joint, wherein at least one of the first, second, third, or fourth hinge joints allow at least a 270 degree range of motion so that the body portion can be arranged in a stack;

a lid that is configured to join to the body portion when the four panels are arranged in a box configuration, the lid including a joining portion that is configured to fasten to the rear panel and is hingeably joined to a main top portion of the lid, the lid including an electronically controlled locking mechanism that is operable to lock the top portion of the lid to the body portion; and a floor portion that is configured to be fastened to the rear, front, right side, and left side panels at a bottom of each of the rear, front, right side, and left side panels when the rear, front, right side, and left side panels are arranged in the box configuration.

12. The parcel delivery locker of claim 11, wherein the lid further comprises a wireless networking transceiver that is configured to receive wireless commands to lock and unlock the lid from the body portion.

13. The parcel delivery locker of claim 11, wherein the one of the left side panel or the right side panel that is hingeably joined to the rear panel comprises a joining section that is hingeably joined to one of the left side panel or the right side panel, and wherein the joining section overlaps with a portion of the rear panel to receive fasteners that pass through both the joining section and the rear panel.

14. The parcel delivery locker of claim 11, wherein the floor portion comprises at least two joining portions that are hingeably joined to a main floor panel portion wherein the at least two joining portions are on opposite ends of the main floor panel portion and overlap with opposing ones of the four panels, and wherein fasteners pass through the at least two joining portions and the panels.

15. The parcel delivery locker of claim 14, wherein the fasteners are fastening pegs having a shaft and head, the shaft having a notch at a right angle to an axis of the shaft, and the parcel delivery locker further includes a retaining member having a portion that fits into the notch on each one of the fastening pegs at an inside of the parcel delivery locker.

16. The parcel delivery locker of claim 11, wherein the four panels are hingeably joined by a plurality of interleaving hinge knuckles along their respective vertical edges, and a hinge pin that passes through each of the plurality of interleaving hinge knuckles, wherein the vertical edges adjacent the interleaving hinge knuckles are chamfered at a forty five degree angle relative to a major surface of the panels.

17. The parcel delivery locker of claim 16, wherein the hinge knuckles are disposed on an inside surface of the panels.

18. The parcel delivery locker of claim 17 wherein the hinge knuckles have a square cross section.

19. The parcel delivery locker of claim 17 wherein the hinge knuckles have a triangular cross section.

20. The parcel delivery locker of claim 19, wherein the hinge knuckles fit into corresponding recesses on an adjoining panel.

* * * * *